US010222130B2

(12) United States Patent
Kennedy et al.

(10) Patent No.: US 10,222,130 B2
(45) Date of Patent: Mar. 5, 2019

(54) WORK MACHINE HEAT EXCHANGER

(71) Applicant: Caterpillar Inc., Peoria, IL (US)

(72) Inventors: Joseph L. Kennedy, Peoria, IL (US); Dongming Tan, Dunlap, IL (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/230,545

(22) Filed: Aug. 8, 2016

(65) Prior Publication Data

US 2018/0038656 A1 Feb. 8, 2018

(51) Int. Cl.

| | |
|---|---|
| ***F28F 9/00*** | (2006.01) |
| ***F28D 9/00*** | (2006.01) |
| ***F28F 3/02*** | (2006.01) |
| ***F28F 9/007*** | (2006.01) |
| ***F28F 9/02*** | (2006.01) |
| ***F28D 1/04*** | (2006.01) |
| ***F28D 1/053*** | (2006.01) |
| *F28D 21/00* | (2006.01) |

(52) U.S. Cl.

CPC ..... *F28D 9/0093* (2013.01); *F28D 1/0443* (2013.01); *F28D 1/05366* (2013.01); *F28D 9/0037* (2013.01); *F28F 3/025* (2013.01); *F28F 9/0075* (2013.01); *F28F 9/0214* (2013.01); *F28D 2021/0094* (2013.01); *F28F 2265/26* (2013.01); *F28F 2270/00* (2013.01); *F28F 2270/02* (2013.01)

(58) Field of Classification Search

CPC ..... F28D 1/0408; F28D 1/0443; F28F 2009/0287; F28F 2270/00

USPC ..... 165/135, 140

See application file for complete search history.

(56) References Cited

U.S. PATENT DOCUMENTS

| | | | | |
|---|---|---|---|---|
| 4,137,982 | A * | 2/1979 | Crews | B60K 11/04 123/41.51 |
| 6,250,103 | B1 * | 6/2001 | Watanabe | F25B 39/04 62/509 |
| 7,077,193 | B2 | 7/2006 | Kamiyama et al. | |
| 7,490,659 | B2 | 2/2009 | Kwon et al. | |
| 2005/0133207 | A1 | 6/2005 | Scoville et al. | |
| 2007/0062671 | A1 | 3/2007 | Sugimoto et al. | |
| 2008/0148746 | A1 | 6/2008 | Yanik et al. | |

(Continued)

FOREIGN PATENT DOCUMENTS

| | | | |
|---|---|---|---|
| JP | 10213382 | * | 8/1998 |
| JP | 20060242432 | | 9/2006 |

*Primary Examiner* — Eric Ruppert

(74) *Attorney, Agent, or Firm* — Oblon, McClelland, Maier & Neustadt

(57) ABSTRACT

A work machine heat exchanger is provided. The work machine heat exchanger includes an upstream tank having an inlet and a downstream tank having an outlet. The work machine heat exchanger also includes a first core and a second core, both coupled between the upstream and the downstream tank, and including a first inner side sheet and a second inner side sheet, respectively. The first and the second inner side sheet define an air gap between the first and the second core. A pair of supporting bars are stacked between the first and the second inner side sheet, and configured to retain the first and the second inner side sheet parallel to each other. A first supporting bar of the pair of supporting bars is attached to the upstream tank and a second supporting bar of the pair of supporting bars is attached to the downstream tank.

16 Claims, 7 Drawing Sheets

(56) References Cited

U.S. PATENT DOCUMENTS

| | | | | |
|---|---|---|---|---|
| 2009/0038778 | A1 | 2/2009 | Korth et al. | |
| 2010/0218914 | A1* | 9/2010 | Irmler | F02B 29/0475 165/67 |
| 2012/0011867 | A1 | 1/2012 | Koons et al. | |
| 2012/0227943 | A1 | 9/2012 | Nakashima | |
| 2013/0175016 | A1 | 7/2013 | Steele et al. | |
| 2013/0220584 | A1* | 8/2013 | Mishiro | F25B 39/00 165/143 |
| 2016/0109191 | A1 | 4/2016 | Skrzyniarz et al. | |

* cited by examiner

WORK MACHINE HEAT EXCHANGER

TECHNICAL FIELD

The present disclosure relates to a work machine and more particularly to a heat exchanger for the work machine.

BACKGROUND

Typically, a heat exchanger includes an upstream tank, a downstream tank, a core coupled between the upstream and the downstream tank, and fins stacked within the core. The core includes multiple tubes to allow flow of coolant from the upstream tank to the downstream tank. On completion of each circulation through the engine, the coolant is routed to the upstream tank of the heat exchanger. The coolant further flows through the tubes to lose heat to a stream of air flowing across the core. The coolant associated with ambient temperature is received at the downstream tank and is supplied to the engine for further circulation. Based on various operating parameters of engine, two or more heat exchangers are employed in the machine to treat the temperature of the coolant of the engine. Owing to space constraint in the machine, conventionally, the two or more heat exchangers are combined to constitute a single heat exchanging module.

Conventional methods of combining the heat exchangers include directly connecting outermost tubes or outermost column of fins of each heat exchanger. In cases where the coolant associated with high temperature flows through the heat exchangers, temperature gradients may develop between adjacent cores and may lead to development of thermal stresses within each core. In addition, during high temperature conditions, the adjacent cores may tend to expand. However, since the outermost tubes or outermost column of fins are directly connected, expansion of the cores is restricted. Such conditions add to the thermal stresses developed within the single heat exchanger module.

U.S. Patent Publication No. 2016/0109191 (the '191 publication) describes a cooling module that includes multiple heat exchangers, at least one of which is a coolant radiator. Specifically, the '191 publication discloses a charge air cooler heat exchanging core stacked and directly connected between a radiator heat exchanging core and an oil cooler heat exchanging core. As such, thermal stresses may be developed in the charge air cooler heat exchanging core. Therefore, the '191 publication fails to overcome the thermal stresses developed in the charge air cooler heat exchanging core.

SUMMARY OF THE DISCLOSURE

In one aspect of the present disclosure, a work machine heat exchanger is provided. The work machine heat exchanger includes an upstream tank having at least one inlet to receive fluid therein and a downstream tank having at least one outlet. The work machine heat exchanger also includes a first core and a second core, coupled between the upstream tank and the downstream tank. The first core and the second core include a first inner side sheet and a second inner side sheet, respectively. Each of the first inner side sheet and the second inner side sheet is attached to the upstream tank and the downstream tank and define an air gap between the first core and the second core. The work machine heat exchanger also includes a pair of supporting bars stacked between the first inner side sheet and the second inner side sheet, and configured to retain the first inner side sheet parallel to the second inner side sheet. A first supporting bar of the pair of supporting bars is attached to the upstream tank and a second supporting bar of the pair of supporting bars is attached to the downstream tank.

In another aspect of the present disclosure, a work machine heat exchanger is provided. The work machine heat exchanger includes an upstream tank having at least one inlet to receive fluid therein and a downstream tank having at least one outlet. The work machine heat exchanger also includes a first core and a second core, coupled between the upstream tank and the downstream tank. The first core includes a first inner separator sheet, a first set of secondary separator sheets, and a set of first flow passages in fluid communication with the upstream tank and the downstream tank. The set of first flow passages is configured to allow flow of fluid from the upstream tank to the downstream tank. Each adjacent flow passage of the set of first flow passages is defined by a pair of secondary separator sheets from the first set of secondary separator sheets. An innermost first flow passage of the set of first flow passages is defined by the first inner separator sheet and a secondary separator sheet of the first set of secondary separator sheets. Further, a thickness of the first inner separator sheet is greater than thickness of each secondary separator sheet of the first set of secondary separator sheets. The second core includes a second inner separator sheet, a second set of secondary separator sheets, and a set of second flow passages in fluid communication with the upstream tank and the downstream tank. The set of second flow passages is configured to allow flow of fluid from the upstream tank to the downstream tank. An innermost second flow passage of the set of second flow passages is defined by the second inner separator sheet and a secondary separator sheet of the second set of secondary separator sheets. Each adjacent flow passage of the set of second flow passages is defined by a pair of secondary separator sheets from the second set of secondary separator sheets. Further, a thickness of the second inner separator sheet is greater than thickness of each secondary separator sheet of the second set of secondary separator sheets. The work machine heat exchanger also includes a pair of supporting bars stacked between the first inner separator sheet and the second inner separator sheet, and configured to retain the first inner separator sheet parallel to the second inner separator sheet. A first supporting bar of the pair of supporting bars is attached to the upstream tank and a second supporting bar of the pair of supporting bars is attached to the downstream tank.

In yet another aspect of the present disclosure, a work machine is provided. The work machine includes an engine and a work machine heat exchanger in fluid communication with the engine. The work machine heat exchanger includes an upstream tank having at least one inlet to receive fluid therein from the engine and a downstream tank having at least one outlet to supply the fluid to the engine. The work machine heat exchanger also includes a first core and a second core, each coupled between the upstream tank and the downstream tank. The work machine heat exchanger further includes a pair of supporting bars stacked between the first core and the second core. A first supporting bar of the pair of supporting bars is attached to the upstream tank and a second supporting bar of the pair of supporting bars is attached to the downstream tank. The first core and the second core are separated by an air gap and a width of the air gap is equal to a width of the first supporting bar.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
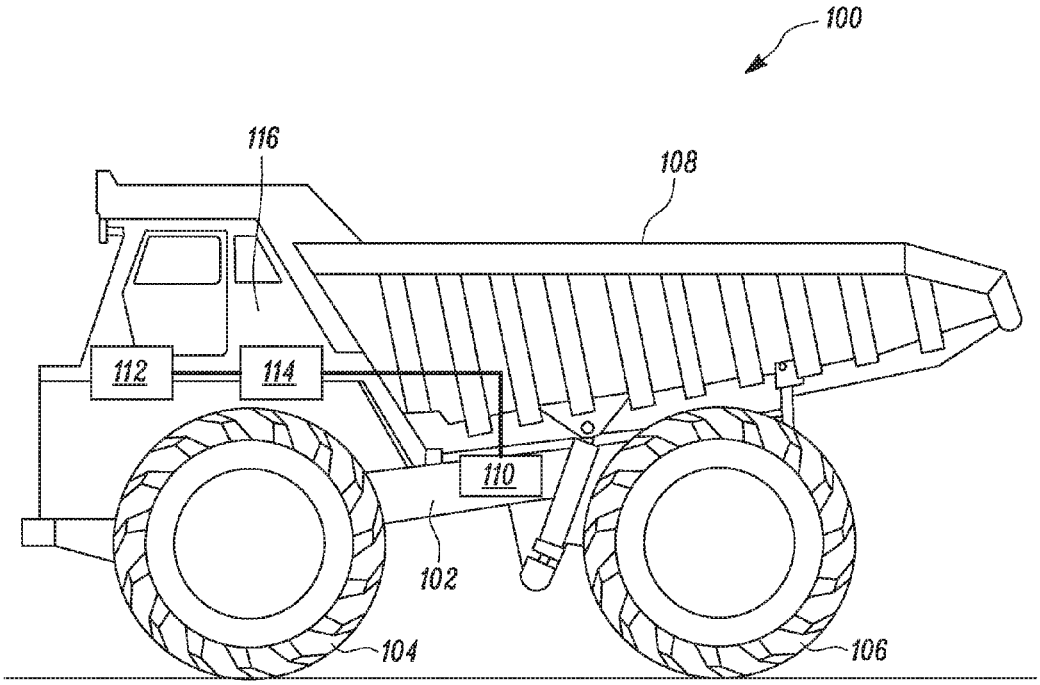
FIG. 1 is a side view of a work machine equipped with an engine and a work machine heat exchanger, according to an embodiment of the present disclosure.

Referring to FIG. 1, a side view of a work machine 100, according to an embodiment of the present disclosure, is illustrated. The work machine 100 is embodied as a large mining truck (LMT). Alternatively, the work machine 100 may be an off-highway truck, an on-highway truck, a dump truck, an articulated truck, a loader, an excavator, a pipe layer, or a motor grader. The work machine 100 may be any machine associated with various industrial applications, including, but not limited to, mining, agriculture, construction, and other industrial applications. The work machine 100 includes a frame 102, a front set of ground engaging propulsion members 104 coupled to the frame 102, and a rear set of ground engaging propulsion members 106 coupled to the frame 102. A dump body 108 pivotally coupled to the frame 102 is capable of being operated between a lowered position (as shown in FIG. 1) and a lifted position, in a conventional manner. The work machine 100 further includes a transmission system 110 to drive the front and the rear set of ground engaging propulsion members 104, 106. Further, an engine cooling system 112 is deployed for maintaining temperature of an engine 114 supported by the frame 102. A cab 116 is mounted on the frame 102 to house an operator control station (not shown) that includes a variety of operator input devices for controlling and monitoring operation of the work machine 100.

Figure 2:
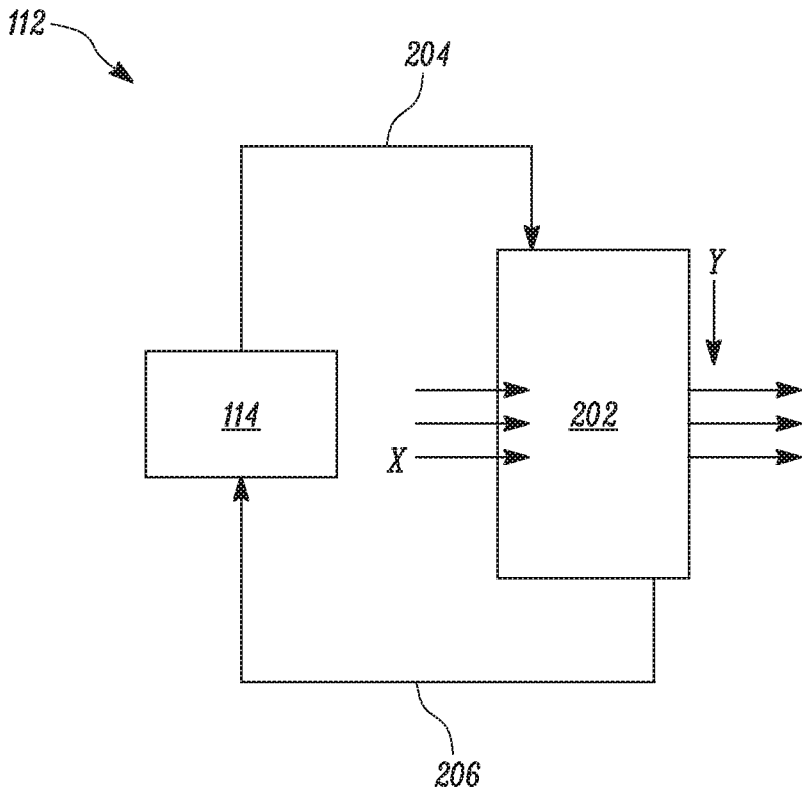
FIG. 2 is a schematic diagram of an engine cooling system of the work machine including the engine and the work machine heat exchanger, according to an embodiment of the present disclosure.

A schematic diagram of the engine cooling system 112, according to an embodiment of the present disclosure, is illustrates in FIG. 2. For the purpose of the present disclosure, the engine cooling system 112 is illustrated to include the engine 114 and a work machine heat exchanger 202 in fluid communication with the engine 114. It will be understood that the engine cooling system 112 can employ additional components, such as an oil cooler (not shown) and a shunt tank (not shown), to assist in operation of the engine cooling system 112. The engine 114 may be an air-cooled engine or a water-cooled engine. During operation of the engine 114, due to combustion process taking place within the engine 114, various components of the engine 114 get heated up and it is desired that the components are cooled. Accordingly a coolant, such as oil or water, is supplied to the engine 114, from a reservoir (not shown), to reduce temperature of such components. The supplied coolant is allowed to flow through passages provided within the engine 114, thereby absorbing heat from the components.

Heat absorbed coolant exiting the engine 114 is routed to the work machine heat exchanger 202, hereinafter referred to as the heat exchanger 202, via a first flow path 204. The heat exchanger 202 includes multiple flow passages, which is described with reference to subsequent figures, to allow flow of the heat absorbed coolant in a direction 'Y', as shown in FIG. 2. While the heat absorbed coolant flows in the direction 'Y', a current of air flows across the heat exchanger 202 in a direction 'X', as shown in FIG. 2. Such perpendicular flows of the coolant and the air through the heat exchanger 202 allow exchange of heat between the heat absorbed coolant and the air. As such, the heat absorbed coolant loses heat to air while the heat absorbed coolant flows in the direction 'Y'. Further, cooled coolant is supplied back to the engine 114 via a second flow path 206.

Figure 3:
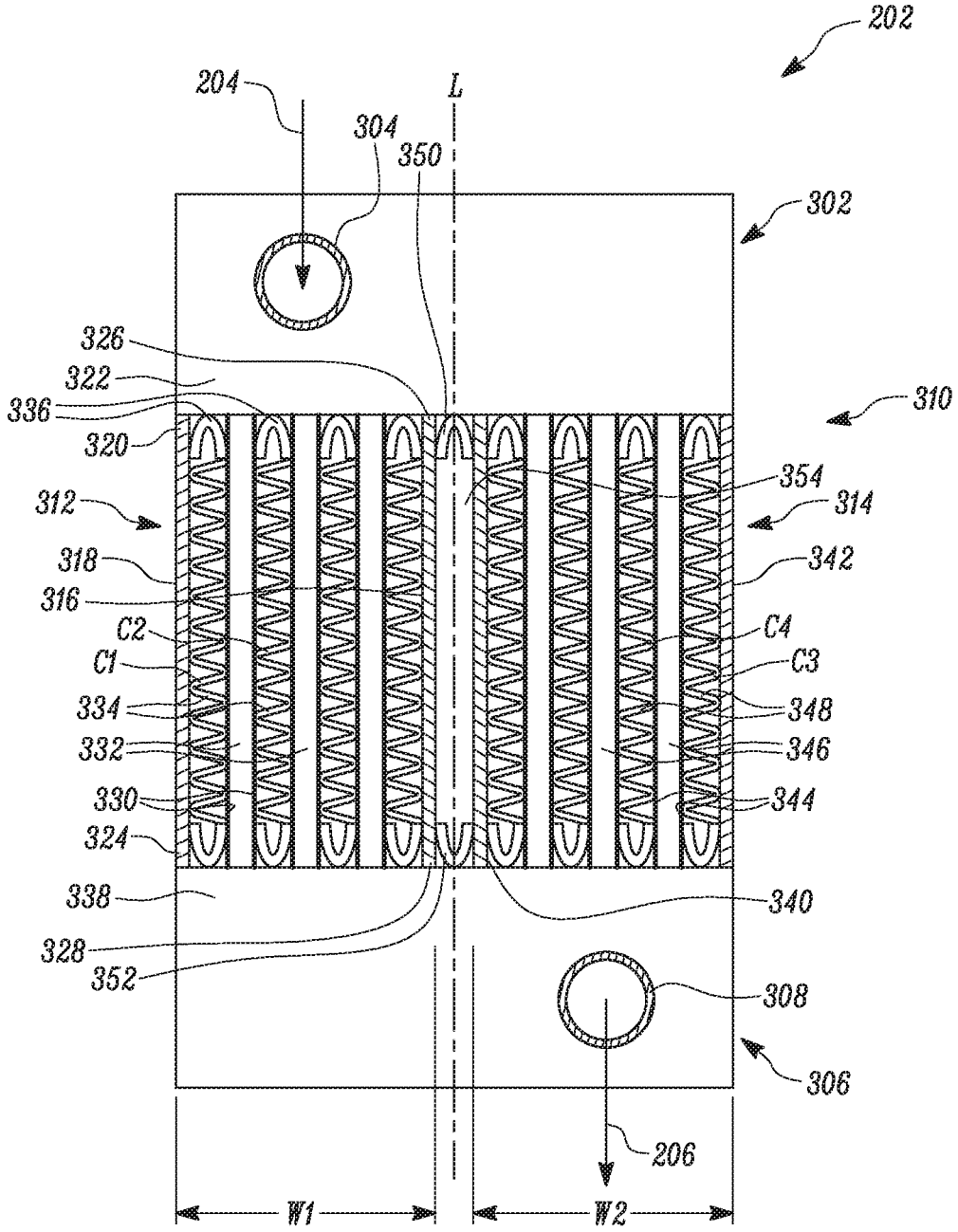
FIG. 3 is a schematic cross-section of the work machine heat exchanger equipped with side sheets to define an air gap between heat exchanging cores, according to an embodiment of the present disclosure.

FIG. 3 illustrates a schematic cross-section of the heat exchanger 202, according to an embodiment of the present disclosure. The heat exchanger 202 includes an upstream tank 302 having at least one inlet 304 to receive fluid therein. In an example, the upstream tank 302 may be embodied as a reservoir having, but not limited to, a rectangular cross-section, and volume of the upstream tank 302 may be predetermined based on power rating of the engine 114. The at least one inlet 304 is in fluid communication with the first flow path 204 to receive the fluid into the upstream tank 302. The 'heat absorbed coolant' is alternatively referred to as the fluid in the present disclosure. A downstream tank 306 is also provided in the heat exchanger 202 and located distal with respect to the upstream tank 302. Similar to the upstream tank 302, the downstream tank 306 also may be embodied as a rectangular reservoir. At least one outlet 308 is provided in the downstream tank 306 and is in fluid communication with the second flow path 206, to allow flow of fluid from the heat exchanger 202 to the engine 114. The downstream tank 306 and the upstream tank 302 define a core 310 therebetween that is capable of heat exchange between the fluid and air. In an example, the core 310 may be brazed to the upstream tank 302 and the downstream tank 306.

In an embodiment, the core 310 is constituted by a first core 312 and a second core 314, as illustrated in FIG. 3. As such, each of the first core 312 and the second core 314 is coupled between the upstream tank 302 and the downstream tank 306. The first core 312 includes a first inner side sheet 316, which can be embodied as a rectangular plate of a predetermined thickness. In an example, the thickness of the first inner side sheet 316 may range between 1 millimeter (mm) and 4 mm. While the first inner side sheet 316 serves as one periphery of the first core 312, a first peripheral side sheet 318 of the first core 312 serves as another periphery. Specifically, the first inner side sheet 316 and the first peripheral side sheet 318 define a width 'W1' of the first core 312. Each of the first inner side sheet 316 and the first peripheral side sheet 318 is attached to the upstream tank 302 and the downstream tank 306. For instance, a first end 320 of the first peripheral side sheet 318 can be brazed to a bottom portion 322 of the upstream tank 302 and a second end 324 of the first peripheral side sheet 318 can be brazed to the downstream tank 306. Likewise, a first end 326 and a second end 328 of the first inner side sheet 316 can also be brazed to the upstream tank 302 and the downstream tank 306, respectively. In an example, the thickness of the first inner side sheet 316 may range between 1 mm and 4 mm.

The first core 312 further includes a first set of secondary separator sheets 330 stacked between the upstream tank 302 and the downstream tank 306. Each of the first set of secondary separator sheets 330, hereinafter alternatively referred to as each secondary separator sheet 330 or the secondary separator sheet 330, may be embodied as rectangular plate. In one embodiment, ends of each secondary separator sheet 330 can be brazed to the upstream tank 302 and the downstream tank 306. Further, each secondary separator sheet 330 is positioned parallel to the first inner side sheet 316 and the first peripheral side sheet 318, and extends in a direction perpendicular to a plane containing the FIG. 3. Thickness of each secondary separator sheet 330 is less than the thickness of the first inner side sheet 316. In an example, the thickness of each secondary separator sheet 330 may range between 0.5 mm to 2 mm.

In one embodiment, two secondary separator sheets 330 are stacked one adjacent to the other to define a passage therebetween along a length of the secondary separator sheets 330. A set of fins (not shown) are stacked in the passage defined between the pair of secondary sheets 330. As such, the pair of secondary sheets 330 defines a first flow passage 332 that extends from the upstream tank 302 to the downstream tank 306. The first core 312 includes a set of first flow passages 332 in fluid communication with the upstream tank 302 and the downstream tank 306. Accordingly, the set of first flow passages 332 is configured to allow flow of the fluid from the upstream tank 302 to the downstream tank 306. The set of first flow passages 332 is arranged in an equidistant manner and in a direction along the width 'W1' of the first core 312, as shown in FIG. 3.

With such an arrangement, multiple first fins 334 are stacked with the set of the first flow passages 332, along a longitudinal axis 'L' of the heat exchanger 202. Specifically, the first fins 334 are stacked between each adjacent pair of first flow passages 332. In arrangement, a first column 'C1' of the first fins 334 is stacked adjacent to the first peripheral side sheet 318, followed by one first flow passage 332 of the set of first flow passages 332, followed by a second column 'C2' of the first fins 334, followed by another first flow passage 332 of the set of first flow passages 332, and so on. However, such stacking of columns of the first fins 334 and the set of first flow passages 332 terminate with the first inner side sheet 316. To this end, the set of first flow passages 332 and the first fins 334 are stacked between the first inner side sheet 316 and the first peripheral side sheet 318. The first fins 334 provide additional surface area for flow of air during process of heat exchange between air and the fluid. Whilst the first fins 334 are illustrated with corrugated fin configuration, it will be understood that the first fins 334 can have other configurations as well, for example, but not limited to, plain, perforated, serrated, herringbone, lanced offset, or louvered.

In order to define a width of each column of the first fins 334, in an embodiment, the heat exchanger 202 includes multiple supporting bars 336 stacked between the first inner side sheet 316 and the first peripheral side sheet 318. In particular, the supporting bars 336 are attached to the bottom portion 322 of the upstream tank 302 and a top portion 338 of the downstream tank 306 corresponding to each column of the first fins 334. Each supporting bar 336 may, in an example, include a horse-shoe cross-section, as shown in FIG. 3. Further, the supporting bars 336 can be brazed to the upstream tank 302 and the downstream tank 306 at the corresponding locations as mentioned hereinabove. As such, width of each column of the first fins 334 is equal to a width of the supporting bar 336.

Furthermore, the second core 314 is constituted in a manner identical to arrangement of components of the first core 312. For instance, the second core 314 includes a second inner side sheet 340, a second peripheral side sheet 342, a second set of secondary separator sheets 344, a set of second flow passages 346, and second fins 348. The second inner side sheet 340 serves as an inner periphery of the second core 314 and the second peripheral side sheet 342 serves as an outer periphery of the second core 314. As such, the second inner side sheet 340 and the second peripheral side sheet 342 define a width 'W2' of the second core 314. Each of the second inner side sheet 340 and the second peripheral side sheet 342 is attached to the upstream tank 302 and the downstream tank 306, such that the second inner side sheet 340 and the second peripheral side sheet 342 are parallel to the first inner side sheet 316 and the first peripheral side sheet 318. In an example, ends of each of the second inner side sheet 340 and the second peripheral side sheet 342 can be brazed to the upstream tank 302 and the downstream tank 306. Thickness of each of the second inner side sheet 340 and the second peripheral side sheet 342 can range between 1 mm to 4 mm.

Two secondary separator sheets 344 from the second set of secondary separator sheets 344, which are stacked one beside the other and separated by a predetermined gap, define the second flow passage 346. Further, each secondary separator sheet 344 is stacked between the upstream tank 302 and the downstream tank 306. In an example, thickness of each secondary separator sheet 344 may range between 0.5 mm to 2 mm. Multiple second flow passages 346 are formed along the width 'W2' of the second core 314, thereby constituting the set of second flow passages 346. Each second flow passage 346 is in fluid communication with the upstream tank 302 and the downstream tank 306 and, therefore, configured to allow flow of the fluid from the upstream tank 302 to the downstream tank 306. Furthermore, the second fins 348 are stacked with the set of second flow passages 346, along the longitudinal axis 'L' of the heat exchanger 202.

Specifically, the second fins 348 are stacked between each adjacent pair of second flow passages 346. In arrangement, a first column 'C3' of the second fins 348 is stacked adjacent to the second peripheral side sheet 342, followed by the second flow passage 346 of the set of the second flow passages 346, followed by a second column 'C4' of the second fins 348, followed by another second flow passage 346 of the set of second flow passages 346, and so on. However, such stacking of columns of the second fins 348 and the set of second flow passages 346 terminate with the second inner side sheet 340. To this end, the set of second flow passages 346 and the second fins 348 are stacked between the second inner side sheet 340 and the second peripheral side sheet 342. Similar to the first core 312, the supporting bars 336 are provided in the second core 314 to define width of each column of the second fins 348.

A pair of supporting bars 336, individually referred to as a first supporting bar 350 and a second supporting bar 352, is stacked between the first inner side sheet 316 and the second inner side sheet 340, and configured to retain the first inner side sheet 316 parallel to the second inner side sheet 340. Specifically, the first supporting bar 350 of the pair of supporting bars 336 is attached to the upstream tank 302 and the second supporting bar 352 of the pair of supporting bars 336 is attached to the downstream tank 306. In an embodiment, width of the first supporting bar 350 and the second supporting bar 352 may be greater than width of other supporting bars 336 of the heat exchanger 202 stacked in the first core 312 and the second core 314. As such, the first inner side sheet 316 and the second inner side sheet 340, with aid of the first supporting bar 350 and the second supporting bar 352, define an air gap 354 between the first core 312 and the second core 314. A width of the air gap 354 is equal to the width of the pair of supporting bars 336 stacked between the first inner side sheet 316 and the second inner side sheet 340. Whilst configuration of the second core 314 is described as being identical with that of the first core 312, components of the second core 314 may be arranged in a manner different from that of the first core 312, albeit with few variations to the embodiments described herein.

In operation, the fluid which has absorbed heat from components of the engine 114 flowing through the first flow path 204 is received in the upstream tank 302 via the inlet 304. Since the upstream tank 302 spreads over the first core 312 and the second core 314, the fluid received within the upstream tank 302 is allowed to flow through the set of first flow passages 332 and the set of second flow passages 346. Simultaneously, owing to movement of the work machine 100, the current of air flows across the first core 312 and the second core 314, as illustrated earlier in FIG. 2. Such flow of current of air allows heat transfer between air and the fluid flowing through the first and second flow passages 332, 346. Accordingly, temperature of the fluid is lowered and the fluid is received in the downstream tank 306. The fluid then flows back to the engine 114, from the downstream tank 306 via the outlet 308, to further cool the components of the engine 114.

Figure 4:
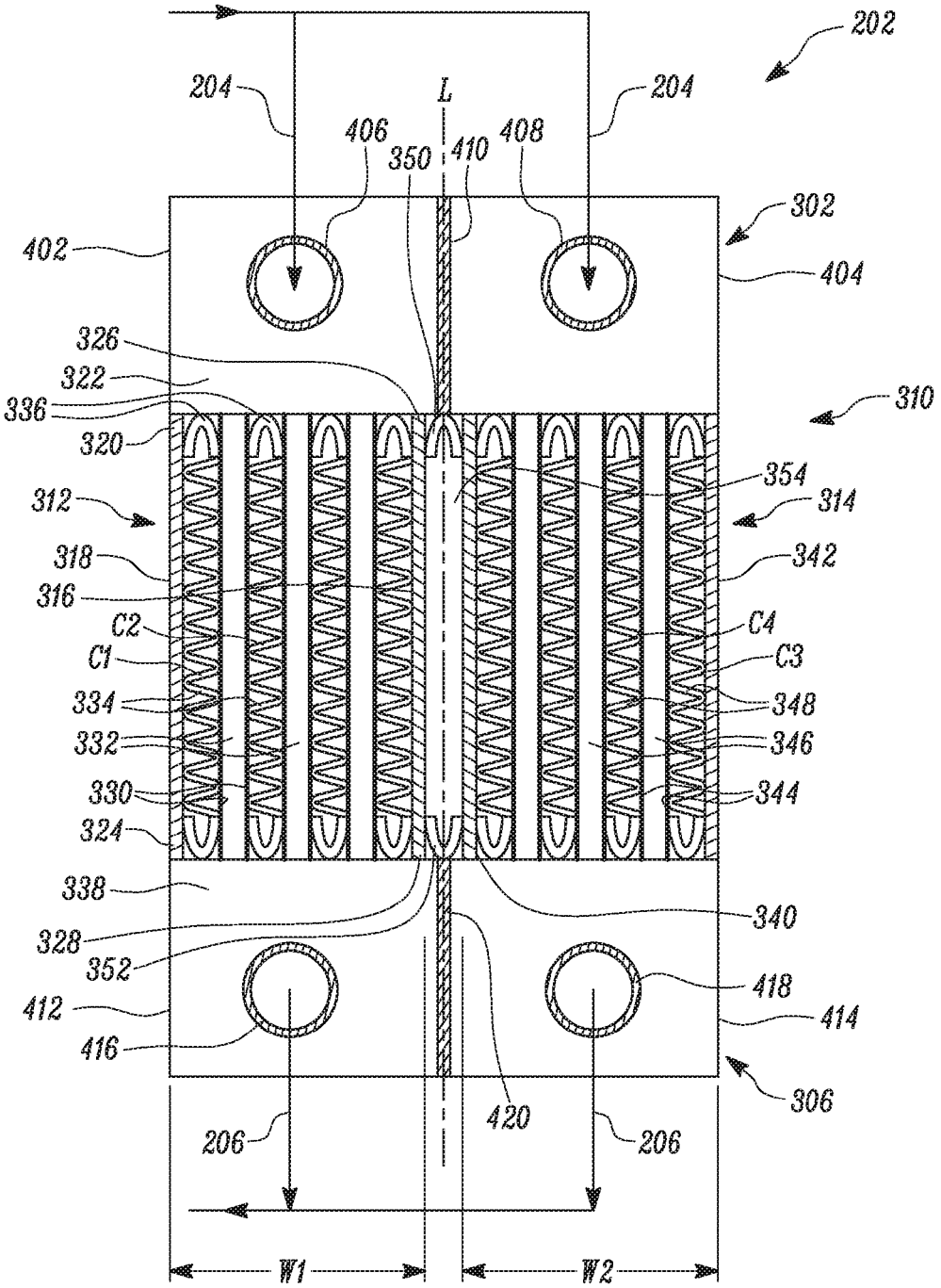
FIG. 4 is a schematic cross-section of the work machine heat exchanger equipped with side sheets to define the air gap between the heat exchanging cores, according to another embodiment of the present disclosure.

FIG. 4 illustrates a schematic cross-section of the heat exchanger 202, according to another embodiment of the present disclosure. The upstream tank 302 is partitioned into a first upstream tank portion 402 and a second upstream tank portion 404. A first inlet 406 is provided in the first upstream tank portion 402 and a second inlet 408 is provided in the second upstream tank portion 404. Each of the first inlet 406 and the second inlet 408 is in fluid communication with the first flow path 204 to receive the fluid from the engine 114.

Further, a first baffle 410 is disposed between the first upstream tank portion 402 and the second upstream tank portion 404. The first baffle 410 may be embodied as a rectangular plate having a predetermined thickness and predetermined heat resistance. The first baffle 410 can be disposed at a predetermined position so that the first upstream tank portion 402 and the second upstream tank portion 404 have equal volumes. In an example, a periphery (not shown) of the first baffle 410 can be brazed to an inner surface (not shown) of the upstream tank 302. Furthermore, the first upstream tank portion 402 is in fluid communication with the first core 312 and the second upstream tank portion 404 is in fluid communication with the second core 314. The first baffle 410 is configured to restrict fluid communication between the first upstream tank portion 402 and the second upstream tank portion 404.

The downstream tank 306 is also partitioned similar to the upstream tank 302, and includes a first downstream tank portion 412 and a second downstream tank portion 414. A first outlet 416 and a second outlet 418 are provided in the first and second downstream tank portions 412, 414, respectively. The first outlet 416 and the second outlet 418 are in fluid communication with the engine 114 via the second flow path 206. A second baffle 420 is disposed between the first downstream tank portion 412 and the second downstream tank portion 414. In an example, a periphery (not shown) of the second baffle 420 can be brazed to an inner surface (not shown) of the downstream tank 306. The second baffle 420 may be embodied as a rectangular plate having a predetermined thickness and predetermined heat resistance. Position of the second baffle 420 may also be predetermined, so that the first and the second downstream tank portions 412, 414 have equal volumes. Further, the second baffle 420 is configured to restrict fluid communication between the first downstream tank portion 412 and the second downstream tank portion 414. The first downstream tank portion 412 is in fluid communication with the first core 312 and the second downstream tank portion 414 is in fluid communication with the second core 314. It should be noted that the configuration of the first core 312 and the second core 314 remains unchanged. In addition, the air gap 354 between the first core 312 and the second core 314 also remains unchanged.

As such, the fluid received in the first upstream tank portion 402 flows through the set of first flow passages 332, loses heat to the air flowing across the first fins 334, and gets collected in the first downstream tank portion 412. Similarly, the fluid received in the second upstream tank portion 404 flows through the set of second flow passages 346, loses heat to the air flowing across the second fins 348, and gets collected in the second downstream tank portion 414. As mentioned earlier, the fluid is thereafter supplied to the engine 114 via the second flow path 206.

In another embodiment, the first upstream tank portion 402, the first core 312, and the first downstream tank portion 412 may constitute a first heat exchanger 422. Likewise, the second upstream tank portion 404, the second core 314, and the second downstream tank portion 414 may constitute a second heat exchanger 424. In such a scenario, the first heat exchanger 422 and the second heat exchanger 424 may be combined to form the heat exchanger 202. For instance, the first heat exchanger 422 and the second heat exchanger 424 may be positioned one beside the other. The first baffle 410 may be introduced between the first upstream tank portion 402 and the second upstream tank portion 404, and the second baffle 420 may be introduced between the first downstream tank portion 412 and the second downstream tank portion 414 while the first heat exchanger 422 is coupled to the second heat exchanger 424. In addition, the first supporting bar 350 and the second supporting bar 352 may be brazed to the first baffle 410 and the second baffle 420, respectively, to define the air gap 354 between the first core 312 and the second core 314.

In yet another embodiment, the first upstream tank portion 402, the first core 312, the first downstream tank portion 412, the second upstream tank portion 404, the second core 314, the second downstream tank portion 414, the first supporting bar 350, and the second supporting bar 352 can be obtained as individual components and can be assembled to form the heat exchanger 202 including the air gap 354 between the first core 312 and the second core 314.

Figure 5:
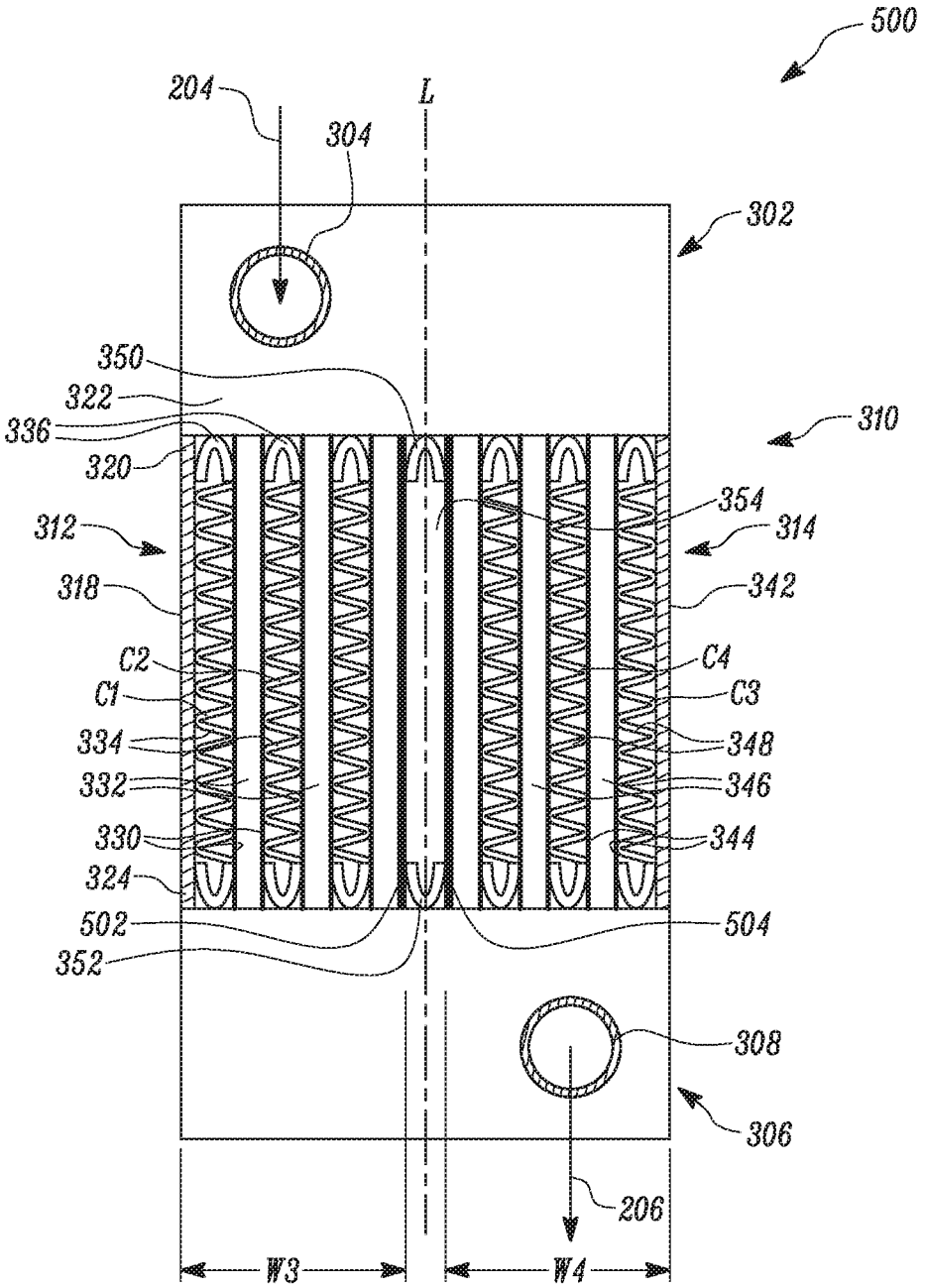
FIG. 5 is a schematic cross-section of the work machine heat exchanger equipped with separator sheets to define the air gap between the heat exchanging cores, according to an embodiment of the present disclosure.

FIG. 5 illustrates a schematic cross-section of a work machine heat exchanger 500, according to an embodiment of the present disclosure. The work machine heat exchanger 500, hereinafter referred to as the heat exchanger 500, includes the upstream tank 302 having the inlet 304, the downstream tank 306 having the outlet 308, and the first core 312 and the second core 314 coupled between the upstream tank 302 and the downstream tank 306.

In accordance with the embodiment illustrated in FIG. 5, the first core 312 includes a first inner separator sheet 502. In an example, the first inner separator sheet 502 may be embodied as a rectangular plate. Thickness of the first inner separator sheet 502 can range between 0.5 mm and 3 mm. The first inner separator sheet 502 is positioned distant and parallel with respect to the first peripheral side sheet 318, thereby defining a width 'W3' of the first core 312 therebetween. As already described with reference to the previous embodiments, the first core 312 also includes the first set of secondary separator sheets 330 stacked between the upstream tank 302 and the downstream tank 306. Other configurations and arrangement of elements of the first core 312 are same as described with reference to the previous embodiments. However, while the first peripheral side sheet 318 serves as one periphery of the first core 312, the first inner separator sheet 502 serves as the other periphery of the first core 312. Further, ends of the first inner separator sheet 502 are attached to the upstream tank 302 and the downstream tank 306.

In arrangement, the first column 'C1' of the first fins 334 is stacked adjacent to the first peripheral side sheet 318, followed by the first flow passage 332 of the set of first flow passages 332, followed by the second column 'C2' of the first fins 334, followed by another first flow passage 332 of the set of first flow passages 332, and so on. As described earlier, each flow passage of the set of first flow passages 332 is defined by a pair of secondary separator sheets 330. However, in an embodiment, an innermost first flow passage 332 of the set of first flow passages 332 is defined by the first inner separator sheet 502 and a secondary separator sheet 330. The stacking of columns of first fins 334 and the set of first flow passages 332 therefore terminate with the first inner separator sheet 502. To this end, the set of first flow passages 332 and the first fins 334 are stacked between the first inner separator sheet 502 and the first peripheral side sheet 318. The thickness of the first inner separator sheet 502 is greater than thickness of each secondary separator sheet 330 of the first set of secondary separator sheets 330.

Similarly, the second core 314, in accordance with the embodiment illustrated in FIG. 5, includes a second inner separator sheet 504. Shape and thickness of the second inner separator sheet 504 correspond to that of the first inner separator sheet 502. For example, the thickness of the second inner separator sheet 504 may also range between 0.5 mm and 3 mm. Ends of the second inner separator sheet 504 are attached to the upstream tank 302 and the downstream tank 306. As described earlier, the second core 314 also includes the second peripheral side sheet 342, the second set of secondary separator sheets 344, and second flow passages 346. Each second flow passage 346 is defined by a pair of secondary separator sheets 344. The second inner separator sheet 504 and the second peripheral side sheet 342 define a width 'W4' of the second core 314.

The first column 'C3' of second fins 348 is stacked adjacent to the second peripheral side sheet 342, followed by the second flow passage 346 of the set of second flow passages 346, followed by the second column 'C4' of the second fins 348, followed by another second flow passage 346 of the set of second flow passages 346, and so on. However, such stacking of columns of second fins 348 and the set of second flow passages 346 terminate with the second inner separator sheet 504. To this end, the set of second flow passages 346 and the second fins 348 are stacked between the second inner separator sheet 504 and the second peripheral side sheet 342. An innermost second flow passage 346 of the set of second flow passages 346 is defined by the second inner separator sheet 504 and the secondary separator sheet 344 of the second set of secondary separator sheets 344. The thickness of the second inner separator sheet 504 is greater than thickness of each secondary separator sheet 344 of the second set of secondary separator sheets 344.

Multiple supporting bars 336 are also stacked within each of the first core 312 and the second core 314. Among the multiple supporting bars 336, a pair of supporting bars 336, such as the first supporting bar 350 and the second supporting bar 352, is stacked between the first inner separator sheet 502 and the second inner separator sheet 504. The pair of supporting bars 336 is configured to retain the first inner separator sheet 502 distal and parallel to the second inner separator sheet 504. The first supporting bar 350 is attached to the upstream tank 302 and the second supporting bar 352 is attached to the downstream tank 306. As such, the first inner separator sheet 502 and the second inner separator sheet 504 define the air gap 354 between the first core 312 and the second core 314.

Figure 6:
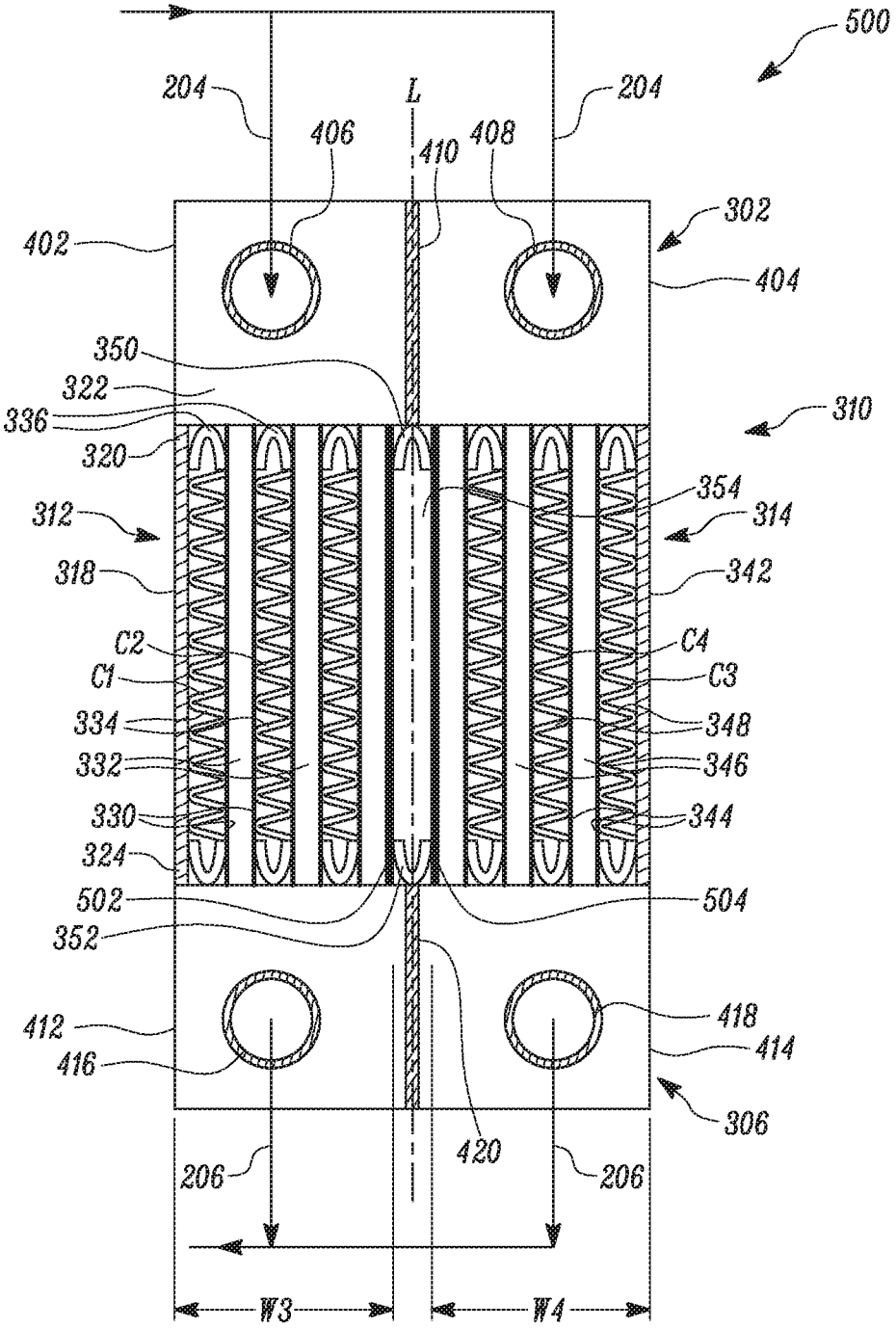
FIG. 6 is a schematic cross-section of the work machine heat exchanger equipped with separator sheets to define the air gap between the heat exchanging cores, according to another embodiment of the present disclosure.

FIG. 6 illustrates a schematic cross-section of the heat exchanger 500, according to another embodiment of the present disclosure. The upstream tank 302 includes the first upstream tank portion 402 and the second upstream tank portion 404 separated by the first baffle 410. The downstream tank 306 includes the first downstream tank portion 412 and the second downstream tank portion 414 separated by the second baffle 420. The first core 312 includes the first inner separator sheet 502 and the second core 314 includes the second inner separator sheet 504. The first inner separator sheet 502 and the second inner separator sheet 504 define the air gap 354 between the first core 312 and the second core 314, when the first core 312 and the second core 314 are stacked one beside the other. It will be appreciated that other constructional features of the heat exchanger 500 correspond to those described in the previous embodiments.

Figure 7:
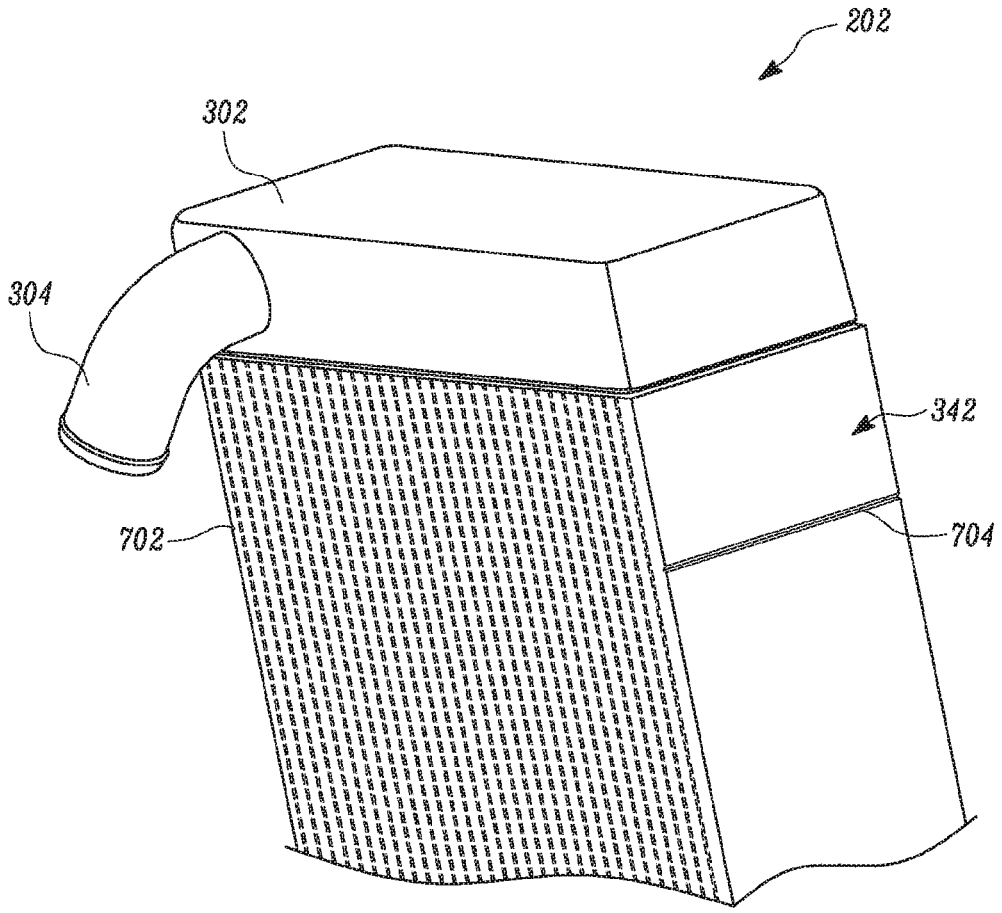
FIG. 7 is a perspective view of a portion of the work machine heat exchanger with a thermal relief groove, according to an embodiment of the present disclosure.

FIG. 7 illustrates a perspective view of a portion of the heat exchanger 202, according to an embodiment of the present disclosure. A first thermal relief groove 702 and a second thermal relief groove 704 are provided on the first peripheral side sheet 318 and the second peripheral side sheet 342, respectively. In an example, the first and second thermal relief grooves 702, 704 can have a V-shaped section. In another example, section of the first and second thermal relief grooves 702, 704 may be predetermined based on material of the first peripheral side sheet 318 and the second peripheral side sheet 342. In yet another example, the section of the first thermal relief groove 702 can be different from a section of the second thermal relief groove 704, and such sections can be predetermined based on type of fluid flowing through the first core 312 and the second core 314, respectively.

When the temperature of the fluid flowing through the first core 312 and the second core 314 is high, the first set of secondary separator sheets 330 and the second set of secondary separator sheets 344 tend to expand in longitudinal direction and transverse direction. As such, the first core 312 and the second core 314 also tend to expand. In such conditions, the first thermal relief groove 702 and the second thermal relief groove 704 allows the first peripheral side sheet 318 and the second peripheral side sheet 342, respectively, to break, thereby allowing expansion of the first and second cores 312, 314.

Various embodiments disclosed herein are to be taken in the illustrative and explanatory sense, and should in no way be construed as limitations to the present disclosure.

INDUSTRIAL APPLICABILITY

The present disclosure relates to the heat exchangers 202, 500 for the work machine 100. As described earlier, the fluid from the engine 114 is received in the upstream tank 302. Owing to the fluid communication between the upstream tank 302 and the first core 312 and the second core 314, the fluid flows through the set of first flow passages 332 and the set of second flow passages 346. When the temperature of the fluid flowing therethrough is high, the set of first flow passages 332 and the second flow passages 346, and therefore the first core 312 and the second core 314, tend to expand in longitudinal direction and transverse direction due to absorption of heat from the fluid. Since the heat exchangers 202, 500 includes the air gap 354, the present disclosure allows expansion of the first core 312 and the second core 314 in an inward direction along the width of the heat exchangers 202, 500. As such, the first core 312 and the second core 314 are allowed to freely expand, without contacting each other.

Therefore, possibility of development of thermal stresses between the first core 312 and the second core 314 is minimized, which otherwise existed due to lack of space between the first core 312 and the second core 314. Further, due to the partition of the upstream tank 302 and the downstream tank 306, or due to combining two heat exchangers, the present disclosure further allows two different fluids to be cooled simultaneously. For example, a first fluid with a first temperature T1 can be allowed to flow through the first core 312 and a second fluid with a second temperature T2 can be allowed to flow through the second core 314. Due to such difference in temperature of the fluids, thermal gradients may be developed in the heat exchangers 202, 500. However, the air gap 354 thermally isolates the first core 312 from the second core 314, thereby eliminating thermal gradients, which otherwise extended between the first core 312 and the second core 314.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A work machine heat exchanger comprising:

an upstream tank having at least one inlet to receive fluid therein, the upstream tank comprising:

a first upstream tank portion having a first inlet of the at least one inlet; and a second upstream tank portion having a second inlet of the at least one inlet;

a downstream tank having at least one outlet, the downstream tank comprising:

a first downstream tank portion having a first outlet of the at least one outlet; and a second downstream tank portion having a second outlet of the at least one outlet;

a first core coupled between and in fluid communication with the first upstream tank portion and the first downstream tank portion, the first core comprising a first inner side sheet attached to the first upstream tank portion and the first downstream tank portion;

a second core coupled between and in fluid communication with the second upstream tank portion and the second downstream tank portion, the second core comprising a second inner side sheet attached to the second upstream tank portion and the second downstream tank portion, wherein the first inner side sheet and the second inner side sheet define an air gap between the first core and the second core; and a pair of supporting bars stacked between the first inner side sheet and the second inner side sheet, and configured to retain the first inner side sheet parallel to the second inner side sheet, wherein a first supporting bar of the pair of supporting bars is attached to the upstream tank and a second supporting bar of the pair of supporting bars is attached to the downstream tank, and wherein the fluid is movable in one direction only in the first core and the second core.

2. The work machine heat exchanger of claim 1, wherein the upstream tank comprises a first baffle disposed between the first upstream tank portion and the second upstream tank portion, and configured to restrict fluid communication between the first upstream tank portion and the second upstream tank portion.

3. The work machine heat exchanger of claim 1, wherein the downstream tank comprises a second baffle disposed between the first downstream tank portion and the second downstream tank portion, and configured to restrict fluid communication between the first downstream tank portion and the second downstream tank portion.

4. The work machine heat exchanger of claim 1, wherein the first core comprises a first set of secondary separator sheets stacked between the upstream tank and the downstream tank, and wherein each pair of secondary separator sheets defines a first flow passage.

5. The work machine heat exchanger of claim 4, wherein the first core comprises:

a set of the first flow passages in fluid communication with the upstream tank and the downstream tank, and configured to allow flow of fluid from the upstream tank to the downstream tank; and a plurality of first fins stacked with the set of the first flow passages along a longitudinal axis of the work machine heat exchanger.

6. The work machine heat exchanger of claim 4, wherein the first core comprises a first peripheral side sheet attached to the upstream tank and the downstream tank, and wherein the set of the first flow passages and the plurality of first fins are stacked between the first inner side sheet and the first peripheral side sheet.

7. The work machine heat exchanger of claim 1, wherein the second core comprises a second set of secondary separator sheets stacked between the upstream tank and the downstream tank, and wherein each pair of secondary separator sheets defines a second flow passage.

8. The work machine heat exchanger of claim 7, wherein the second core comprises:

a set of the second flow passages in fluid communication with the upstream tank and the downstream tank, and configured to allow flow of fluid from the upstream tank to the downstream tank; and a plurality of second fins stacked with the set of the second flow passages along a longitudinal axis of the work machine heat exchanger.

9. The work machine heat exchanger of claim 7, wherein the second core comprises a second peripheral side sheet attached to the upstream tank and the downstream tank, and wherein the set of the second flow passages and the plurality of second fins are stacked between the second inner side sheet and the second peripheral side sheet.

10. The work machine heat exchanger of claim 1, wherein width of the air gap is equal to a width of the pair of supporting bars.

11. The work machine heat exchanger of claim 1, wherein each of the first inner side sheet and the second inner side sheet is brazed to the upstream tank and the downstream tank.

12. The work machine heat exchanger of claim 1, wherein each of the first inner side sheet and the second inner side sheet comprises a thermal relief groove.

13. A work machine comprising:

a frame;

an engine supported by the frame; and a work machine heat exchanger in fluid communication with the engine, the work machine heat exchanger comprising:

an upstream tank having at least one inlet to receive fluid therein from the engine, the upstream tank comprising:

a first upstream tank portion having a first inlet of the at least one inlet; and a second upstream tank portion having a second inlet of the at least one inlet;

a downstream tank having at least one outlet to supply the fluid to the engine, the downstream tank comprising:

a first downstream tank portion having a first outlet of the at least one outlet; and a second downstream tank portion having a second outlet of the at least one outlet;

a first core coupled between and in fluid communication with the first upstream tank portion and the first downstream tank portion;

a second core coupled between and in fluid communication with the second upstream tank portion and the second downstream tank portion; and a pair of supporting bars stacked between the first core and the second core, wherein a first supporting bar of the pair of supporting bars is attached to the upstream tank and a second supporting bar of the pair of supporting bars is attached to the downstream tank, and wherein the first core and the second core are separated by an air gap, and a width of the air gap is equal to a width of the pair of supporting bars, and wherein the fluid is movable in one direction only in the first core and the second core.

14. The work machine of claim 13, wherein the first core comprises a first inner side sheet and the second core comprises a second inner side sheet, the first inner side sheet and the second inner side sheet define the air gap therebetween.

15. The work machine heat exchanger of claim 1, wherein the first upstream tank portion and the second downstream tank portion are located at opposite ends of the first core, and the second upstream tank portion and the second downstream tank portion are located at opposite ends of the second core.

16. The work machine of claim 13, wherein the first upstream tank portion and the second downstream tank portion are located at opposite ends of the first core, and the second upstream tank portion and the second downstream tank portion are located at opposite ends of the second core.

* * * * *